US005201301A

United States Patent [19]

Re

[11] Patent Number: 5,201,301

[45] Date of Patent: Apr. 13, 1993

[54] ADJUSTABLE AMBIENT AIR FILTERING SYSTEM AND POLLUTION CONTROL DEVICE

[75] Inventor: Ron Re, Wilmington, Del.

[73] Assignee: Re-Tech, Inc., New Castle, Del.

[21] Appl. No.: 889,420

[22] Filed: May 28, 1992

[51] Int. Cl.[5] ..... F02B 25/06

[52] U.S. Cl. ..... 123/573; 123/574

[58] Field of Search ..... 123/572, 573, 574

[56] References Cited

U.S. PATENT DOCUMENTS 3,949,719 4/1976 Bellanca et al. ..... 123/574
4,089,309 5/1978 Bush ..... 123/573
4,172,437 10/1979 Lindberg ..... 123/574
4,409,950 10/1983 Goldberg ..... 123/573
4,459,966 7/1984 Sakano et al. ..... 123/573

*Primary Examiner*—Noah P. Kamen
*Attorney, Agent, or Firm*—Connolly & Hutz

[57] ABSTRACT

An ambient air system and pollution control device for an internal combustion engine includes a valve housing having an inlet port for receiving blow by gases from the engine crank case. The housing also includes an ambient air inlet with a flow passageway in the housing in communication with the gas inlet port and with the ambient air inlet. The passageway has a tubular filter at its downstream discharge end so that gases and ambient air may mix in the passageway and be filtered before being discharged from the housing through an outlet port.

7 Claims, 3 Drawing Sheets

ADJUSTABLE AMBIENT AIR FILTERING SYSTEM AND POLLUTION CONTROL DEVICE

BACKGROUND OF THE INVENTION

One of the most serious concerns with vehicles powered by internal combustion engines is the creation of pollution. This presents such a serious problem that pollution control has become by law a necessity in, for example, permitting a vehicle to pass state inspections. Various attempts have been made to provide pollution control devices. These efforts have had limited and varying success.

Crankcase emissions were the first target of law makers and automotive engineers because one-third of the engine emissions originate from this point. Since 1968 and to the present, the PCV system was the standard crankcase ventilation method used on all domestic and foreign cars. The PCV system removes engine crankcase vapor resulting from normal engine blow by-unburned fuel and combustion products leaking past the rings into the crankcase. Manifold vacuum draws fresh air through the crankcase which pulls the undesirable corrosive gases and unburned fuel into the manifold so that they can be burned in the engine. When the PCV valve is open air flows through the air cleaner into the crankcase where it picks up vapor, then into the intake manifold.

SUMMARY OF INVENTION

An object of this invention is to provide an ambient air filtering system and pollution control device which is capable of drastically reducing hydro-carbons and carbonmonoxide pollutants coming out of a conventional engine exhaust system.

Another object of this invention is to provide such a device which is adjustable in controlling the flow of ambient air into the device.

A further object of this invention is to provide such a device which is particularly useable for engines already having high mileage, such as 40,000 miles or more.

A further object of this invention is to provide such a system which can easily be adapted to existing vehicles while drastically reducing pollution.

In accordance with this invention an ambient air filtering system and pollution control device for an internal combustion engine includes a housing which has an inlet port for the blow by gases from the engine crankcase. The housing also includes an ambient air inlet which communicates with a flow passageway in the housing. The inlet port also communicates with the flow passageway so that the ambient air and gases mix in the flow passageway and are then discharged through a tubular filter before being discharged from the housing through an outlet port.

In the preferred practice of this invention an adjustable air flow control device is provided in the passageway from controlling the amount of air which enters and mixes with the blow by gases. Preferably, the filter portion of the housing is a cartridge which is easily replaced. In use, the cartridge would be replaced during normal maintenance at for example the same time as the conventional oil and filter change in the maintenance of a vehicle.

THE DRAWINGS

DETAILED DESCRIPTION

The present invention is based upon the realization that the problem with conventional PCV systems is that the fresh air being taken into the engine through the air cleaner is being diluted by all of the gases in the crankcase. When the gases and other contaminants are being pulled through the PCV valve back through the intake manifold and mixed with already incoming fuel it is virtually impossible for these gases, contaminants and fuel to be totally burnt, thus allowing them to escape through the exhaust system into the atmosphere as pollution. This problem is particularly acute with engines having several thousand miles thus having a greater amount of blow by.

Figure 1:
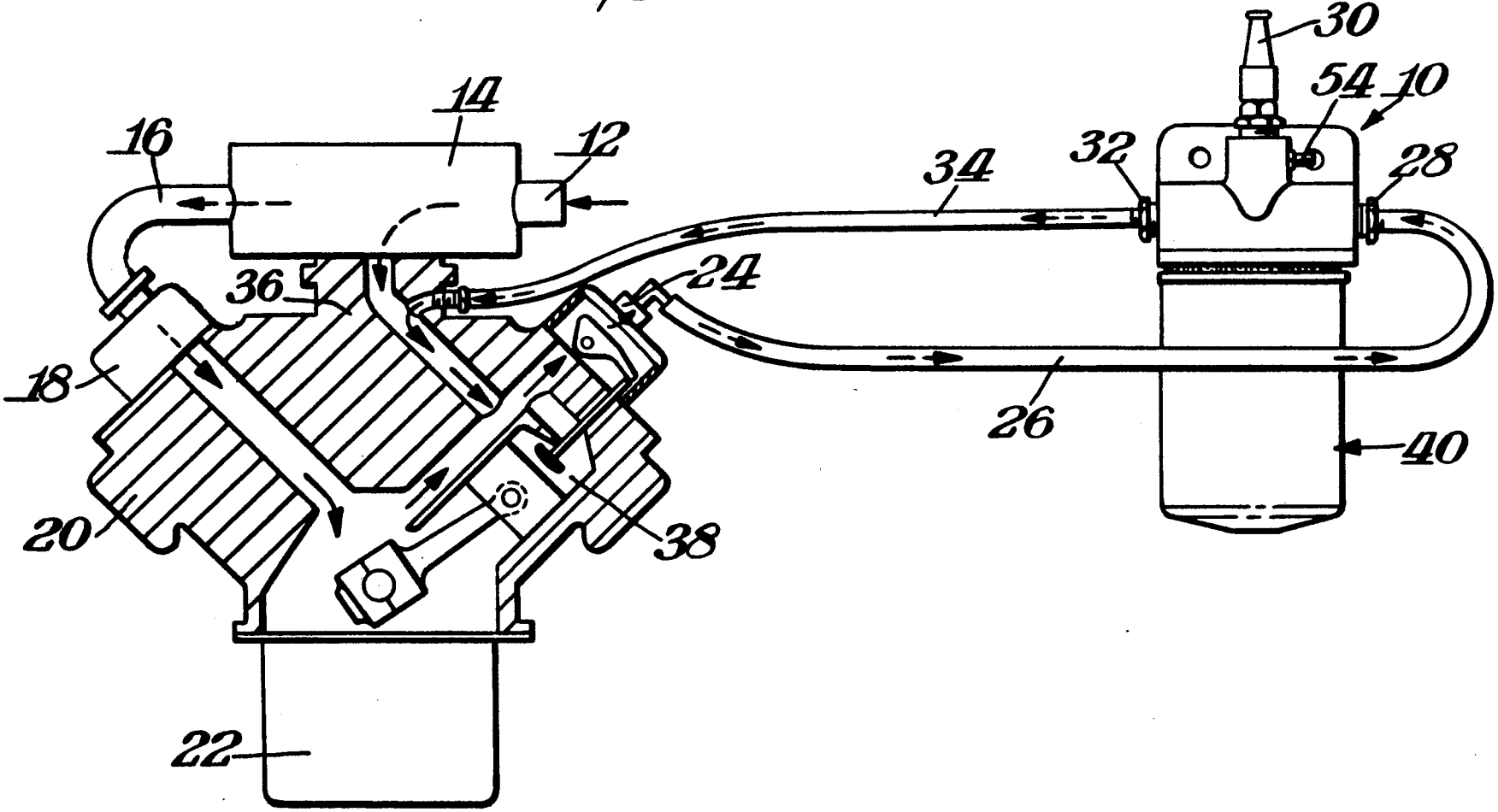
FIG. 1 is a schematic view of a vehicle internal combustion engine which incorporates the ambient air filtering system and pollution control device of this invention.

The present invention involves an ambient air filtering system and pollution control device 10 which would be usable with an internal combustion engine. FIG. 1, for example, illustrates the incorporation of device 10 in a conventional engine system. As shown therein, fresh air enters through the fresh air intake 12 and travels through the air filter 14 and then through pipe 16 through valve cover 18 as indicated by the arrow. From the valve cover the air travels into engine 20 to the crankcase 22. Air and gases mix together in the crankcase. The crankcase blow by gases are pulled out of the crankcase under vacuum through PCV valve 24 and then through hose 26 to inlet port connector 28. The ambient air enters inlet 30 and mixes with the blow by gases from inlet port connector 28 as later described. Vacuum pulls the mixture out of outlet port connector 32 through hose 34 into intake manifold 36. The gases then travel to the combustion chamber 38 to be burnt.

Figure 3:
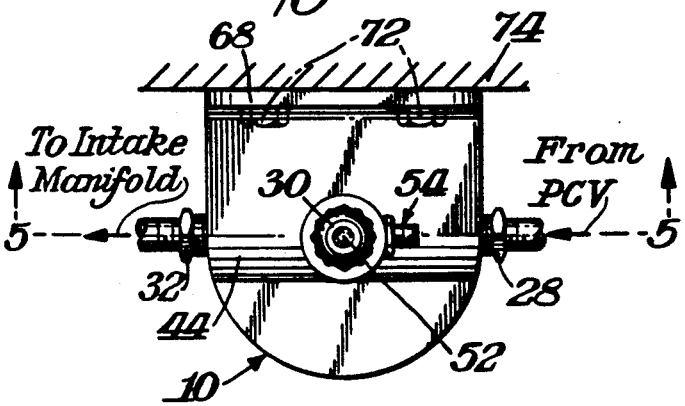
FIG. 3 is a top plan view of the device shown in FIG. 2 mounted to the vehicle.
Figure 4:
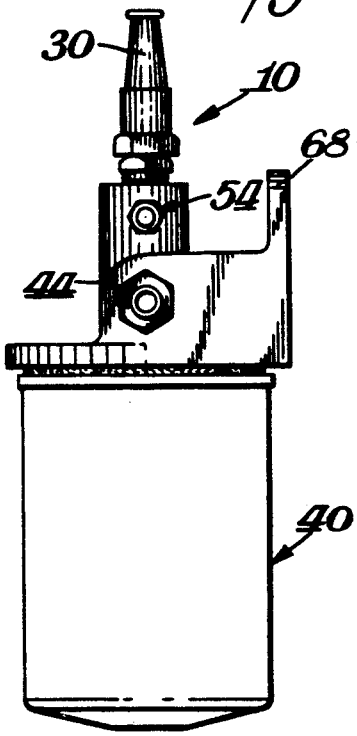
FIG. 4 is a side elevational view of the device shown in FIGS. 2–3 in its assembled condition.
Figure 5:
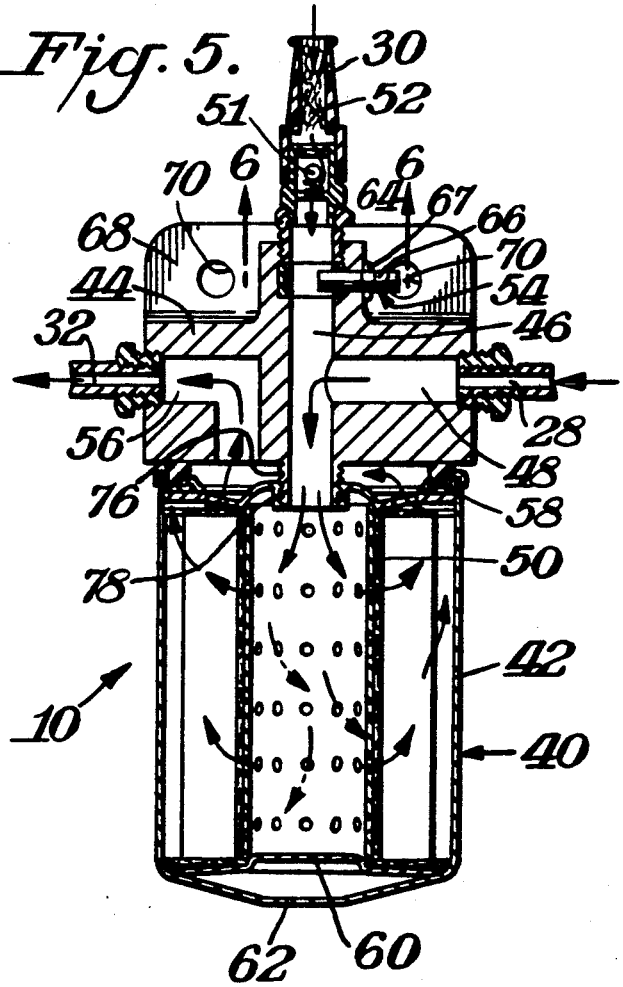
FIG. 5 is a cross-sectional view taken through FIG. 3 along the line 5—5.

FIGS. 2–6 illustrate the details of ambient air filtering system and pollution control device 10. As shown therein, device 10 includes a housing 40 which may be in two part form. The lower portion of housing 40 may be a detachable cartridge or chamber 42 with the upper portion being a solid injection molded block 44. Flow passageway 46 is formed in block 44 in flow communication with ambient air inlet 30. Inlet port connector 28 in turn communicates with a side passage 48 which communicates with flow passageway 46. As illustrated in FIG. 5 the communication of inlet port connector 28 with flow passageway 46 is located at a first upstream portion of flow passageway 46 while ambient air inlet 30 communicates with flow passageway 46 at a second upstream portion of flow passageway 46. Tubular filter 50 is mounted at the downstream end of flow passageway 46.

As illustrated the blow by gases which come from the crankcase flow through inlet port 28 into flow passageway 46 and mix with ambient air entering flow passageway 46 through ambient air inlet 30 after passing through filter 52 and check valve 51.

An important feature of this invention is the utilization of a flow control device 54 which extends into flow passageway 46 between the areas of communication of flow passageway 46 with inlet port connector 28 and ambient air inlet 30. Flow communication device 54 functions to control the amount of air entering housing 40 so as to control the mixture of ambient air with blow by gases.

As illustrated in FIG. 5 the ambient air mixes with the blow by gases in flow passageway 46 and the mixture is discharged through filter 50. The filtered mixture then flows through lower chamber 42 and through outlet passageway 56 formed in block 44 and then through outlet port connector 32 as previously described.

Figure 2:
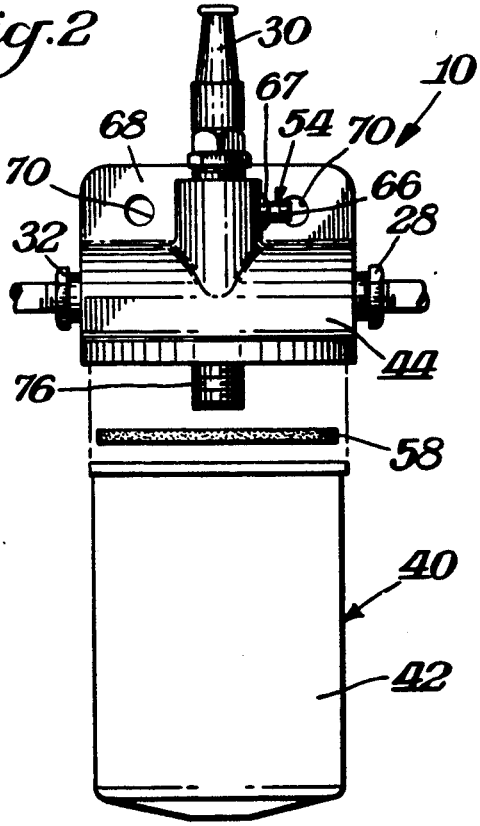
FIG. 2 is an exploded view of the ambient air filtering system and pollution control device shown in FIG. 1.

As best illustrated in FIGS. 2, 4 and 5 during the assembly of block 44 to lower chamber or cartridge 42 a suitable sealing member such as annular gasket 58 is located at the upper edge of cartridge 42 so as to create a sealed housing for maintaining the flow through the proper passageways in housing 40 without any leakage. The upper wall of cartridge 42 includes a threaded opening 78 for threaded engagement with externally threaded item 76 at the end of passageway 46. Thus cartridge 42 is readily coupled to block 44. Advantageously cartridge 42 may be a conventional oil filter.

Any suitable filter material may be used for filter 52, such as a woven material. It is an important feature of the invention, however, that tubular portion 50 is made from paper since this has been found to be particularly effective as a filter material in device 10. As illustrated in FIG. 5 the lower end of tubular filter end 50 is closed by plate member 60 disposed inwardly above the bottom wall 62 of housing 40.

Figure 6:
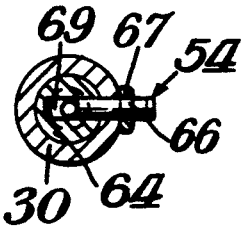
FIG. 6 is a cross-sectional view taken through FIG. 5 along the line 6—6.

FIGS. 5–6 illustrate the details of flow control device 54. As shown therein a plug member 64 is mounted in tubular passageway 46. One end of plug member 64 is threaded for threaded engagement with screw 66. Screw 66 is mounted to the housing by engagement with nut 67. Plug member 64 includes an axial opening 69 which is dimensioned and spaced to be progressively completely opened and completely closed in accordance with the degree to which screw 66 penetrates plug member 64. Thus, as illustrated in FIG. 5 where screw 66 is substantially retracted from plug member 64, a substantial flow is permitted through plug member 64. Where, however, screw 66 is manipulated to extend further into plug member 64 the flow of ambient air through passageway 46 is correspondingly reduced.

Although a specific form of flow control device has been illustrated and described it is to be understood that any suitable form of flow control device may be used which provides an adjustment of the amount of ambient air that may mix with the blow by gases. The flow control device thereby allows a controlled amount of air to enter and mix with the blow by gases. A four gas analyzer would be used to determine the proper adjustments in order to obtain the lowest CO and HC reading without raising the $O_2$ reading or lowering the $CO_2$ reading. These adjustments would vary depending on the number of cylinders, cubic inches and mileage of the engine.

As illustrated in FIGS. 3–5 block 44 includes a back wall 68 which functions as a mounting bracket. Wall 68, may for example, include a set of openings 70 through which fasteners 72 may extend to mount device 10 to a suitable support structure 74 in the engine compartment as illustrated, for example, in FIG. 3.

The incorporation of device 10 in an internal combustion system provides dramatic results in producing pollution control. The following tests listed in the TABLE indicate the results by incorporating device 10 in such a system as compared with the system not including such a device.

All testing was done using the Allen Diagnostic Computer Digital Engine Analyzer on a 1974, GM, 350 cubic inch, 270 horsepower engine with a 4 barrel carburetor with 80,000 miles on the engine.

The engine was tuned up and parts replaced were a new electronic distributor, distributor cap, spark plug wires, spark plugs and coil. The carburetor was replaced with a 1980 quadrejet 4 barrel as this carburetor is more efficient than the 1974 quadrejet carburetor.

The following tests were performed with and without the use of the ambient air filtering system, pollution control device 10.

The test results clearly show the reductions of the %CO and the ppm HC.

| WITHOUT DEVICE 10 | WITH DEVICE 10 | BENEFITS OF DEVICE 10 |
|---|---|---|
| % RPM's 774 | % RPM's 814 | % PM's 40 |
| % CO 4.66 | % CO 0.87 | % CO 3.79 |
| ppm HC 221 | ppm HC 92 | ppm HC 129 |
| % $CO_2$ 11.0 | % $CO_2$ 13.1 | % $CO_2$ 2.1 |
| % $O_2$ 0.5 | % $O_2$ 0.4 | % $O_2$ 0.1 |

As shown by the test results, not only does the device 10 lower the %CO and the ppm HC but it significantly increases the efficiency of the engine by raising the % $CO_2$.

Device 10 provides a number of distinct advantage over other attempts at providing pollution control. For example, with device 10 it is possible to allow constant control fresh air to mix with the gases after leaving the crankcase through the PCV valve then to be pulled through the filter before entering the intake manifold to be burnt.

The invention also makes it possible to filter out not only the fresh air but to stop any contaminants that may be sucked out of the crankcase from entering the intake manifold or the combustion chambers.

Additionally, device 10 is designed to use a standard conventional type throw away oil filter as the lower chamber 42. This filter cartridge would be replaced at the same time that the conventional oil and filter change occurs in normal vehicle maintenance.

Device 10 further permits the use of a check valve 51 with a filter 52 to allow fresh air to enter the system while not allowing any contaminants in the engine system or in the air to enter the system. Moreover, device 10 includes a mounting bracket to permit easy installation almost anywhere in the engine compartment. Device 10 is thus particularly adaptable for use with existing vehicles, particularly with engines already having high mileage, such as engines having 40,000 miles or more which is particularly an acute problem since such vehicles have greater difficulty in meeting pollution control standards.

What is claimed is:

1. An ambient air filtering system and pollution control device for an internal combustion engine comprising a valve housing, an inlet port mounted to said housing for receiving blow by gases from the engine crankcase, and ambient air inlet mounted to said housing, a flow passageway in said housing, said inlet port communicating with said passageway at a first upstream portion of said passageway, said air inlet communicating with said passageway at a second upstream portion of aid passageway, an outlet connector port mounted to said housing, said passageway having a discharge portion downstream from said first upstream portion and said second upstream portion, and said discharge portion including a discharge filter whereby the gases and ambient air may mix in said passageway and the mixture is filtered by said discharge filter before being discharged from said housing through said outlet port, an adjustable air flow control means between said first upstream portion and said second upstream portion, said air flow control means including a flow control screw selectively movable into and out of said flow passageway, said housing comprising an upper chamber and a cartridge detachably mounted to said upper chamber, and a check valve and filter between said ambient air inlet and said air flow control means to filter ambient air entering said flow passageway.

2. The device of claim 1 wherein said upper chamber is a block, said flow passageway being axially arranged in said block, and said outlet connector port communicating with an outlet passageway in said block.

3. The device of claim 2 wherein said ambient air inlet is in axial communication with said flow passageway, a transverse passage being in said block and communicating with said flow passageway, and said inlet port connector being in axial communication with said transverse passage.

4. The device of claim 3 including a mounting bracket connected to said block.

5. The device of claim 4 including a sealing member disposed between said cartridge and said block whereby said housing is leak proof, and said cartridge being threadably engaged with said block.

6. The device of claim 5 wherein said discharge filter is a paper tube having a closed lower end.

7. The device of claim 6 wherein said block includes an externally threaded axial stem, said flow passageway extending through said stem, and said cartridge being threadably engaged with said stem.

* * * * *